US009127504B2

(12) United States Patent
Sprague

(10) Patent No.: US 9,127,504 B2
(45) Date of Patent: Sep. 8, 2015

(54) CORNER ASSEMBLY FOR METAL FRAMED GLASS PANEL DOORS, WINDOWS AND WALL PARTITIONS

(71) Applicant: Gary Sprague, Los Angeles, CA (US)

(72) Inventor: Gary Sprague, Los Angeles, CA (US)

(73) Assignee: C. R. LAURENCE CO., INC., Los Angeles, CA (US)

( * ) Notice: Subject to any disclaimer, the term of this patent is extended or adjusted under 35 U.S.C. 154(b) by 0 days.

(21) Appl. No.: 14/340,445

(22) Filed: Jul. 24, 2014

(65) Prior Publication Data

US 2015/0113904 A1 Apr. 30, 2015

Related U.S. Application Data

(60) Provisional application No. 61/897,752, filed on Oct. 30, 2013.

(51) Int. Cl.

| | |
|---|---|
| ***E04C 2/38*** | (2006.01) |
| ***E06B 3/70*** | (2006.01) |
| ***E06B 3/964*** | (2006.01) |
| ***E06B 3/968*** | (2006.01) |

(52) U.S. Cl.

CPC ..... *E06B 3/70* (2013.01); *E06B 3/9642* (2013.01); *E06B 3/9687* (2013.01); *E06B 2003/7074* (2013.01)

(58) Field of Classification Search

CPC ..... E04B 1/28; E04C 3/28; E06B 3/70; E06B 3/9642; E06B 3/9687

USPC ..... 52/656.9, 481.1, 665, 476

See application file for complete search history.

(56) References Cited

U.S. PATENT DOCUMENTS

| | | | | | |
|---|---|---|---|---|---|
| 3,749,432 | A * | 7/1973 | Janssen | 52/476 |
| 3,778,175 | A * | 12/1973 | Zimmer | 403/187 |
| 4,455,798 | A * | 6/1984 | Tsakiris | 52/200 |
| 4,506,484 | A * | 3/1985 | Bartlett et al. | 52/476 |
| 4,609,185 | A * | 9/1986 | Prater et al. | 256/65.11 |
| 5,359,828 | A * | 11/1994 | Day | 52/665 |
| 5,396,748 | A * | 3/1995 | Rogers | 52/664 |
| 5,494,370 | A * | 2/1996 | Habicht et al. | 403/403 |
| 6,125,606 | A * | 10/2000 | Larsson | 52/836 |
| 6,712,540 | B2 * | 3/2004 | Schmalzhofer et al. | 403/248 |
| 8,327,596 | B2 * | 12/2012 | Bratton | 52/481.1 |
| 2004/0025459 | A1 * | 2/2004 | Huebner et al. | 52/282.1 |
| 2007/0137134 | A1 * | 6/2007 | Plagemann et al. | 52/656.9 |

* cited by examiner

*Primary Examiner* — Basil Katcheves
(74) *Attorney, Agent, or Firm* — Cislo & Thomas, LLP

(57) ABSTRACT

An improved corner assembly for use with metal framed, floating panel glass doors, windows or wall partitions is provided. The design provides improved structural integrity of frame corner joints such that rail twist and frame racking are minimized. The design features a corner assembly composed of extruded horizontal and vertical framing members where the horizontal framing member is equipped with an integral tongue. The tongue engages a mating groove in the vertical framing member. The sheer block is attached to the horizontal and vertical framing members via mechanical fasteners. Welds are provided at the intersection of the tongue and groove, and between the sheer block and horizontal framing member to provide for increased structural integrity.

31 Claims, 6 Drawing Sheets

CORNER ASSEMBLY FOR METAL FRAMED GLASS PANEL DOORS, WINDOWS AND WALL PARTITIONS

CROSS REFERENCE TO RELATED APPLICATION

This application claims the benefit of U.S. provisional patent application No. 61/897,752 filed on Oct. 30, 2013, the entirety of which is hereby incorporated by reference.

BACKGROUND OF THE INVENTION

1. Field of the Invention

The present invention relates generally to metal framed glass panels and more specifically, to an improved corner assembly for metal framed glass doors, windows and wall partitions.

2. Background of the Invention

It is quite popular to use metal framed glass panels for doors, windows and wall partitions, particularly in commercial establishments. In such installations, the vertical and horizontal metal rails form the frame for the glass panel and are generally of small width so that the major portion of the door, window or wall partition is composed of the glass panel. Aluminum extrusions are commonly used as the metal framing members. Because of the relatively narrow width of the metal framing members however, it is difficult to form strong corner joints between the horizontal and vertical members.

Commercial metal framed glass doors in particular are typically subject to heavy use which causes twisting and racking forces to be applied to the doors. Such forces create substantial stresses at the door corner joints. While many prior art commercial doors have corner joints which can withstand these forces, these joints tend to be bulky and cumbersome, and frequently are still subject to failure from the twisting and racking which result from repeated, long term use.

There remains a need in the art for an improved corner joint construction for metal door frames enclosing glass panels. Such an improved corner joint should provide for greater structural integrity than is presently available in prior art designs to better withstand the rigors of heavy use. Any such corner joint would be equally applicable to window and wall partition frames which, being stationary, typically are subjected to substantially less stress than metal framed glass doors.

It is the purpose of the present invention to provide an improved corner assembly for use in constructing metal framed glass panel doors, windows and wall partitions.

SUMMARY OF THE INVENTION

The present invention provides an improved corner assembly for use with metal framed glass doors, windows and wall partitions. The new corner assembly provides for improved structural integrity of the frame corner joints such that rail twist and frame racking are minimized. The new corner assembly features vertical and horizontal framing members interconnected by a sheer block. The horizontal framing members include a tongue extension that interfaces with a groove in the vertical framing members. (This configuration may be reversed.) The tongue and groove construction improves alignment of the framing members and the interconnecting sheer block. A weld formed at the intersection of the tongue and groove improves the structural rigidity of the corner assembly. A combination of mechanical fasteners and welds interconnect the shear block to the vertical and horizontal framing members.

DETAILED DESCRIPTION OF THE PREFERRED EMBODIMENTS

The present invention will now be described more fully hereinafter with reference to the accompanying drawings, in which preferred embodiments of the invention are shown. The invention may, however, be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Figure 1:
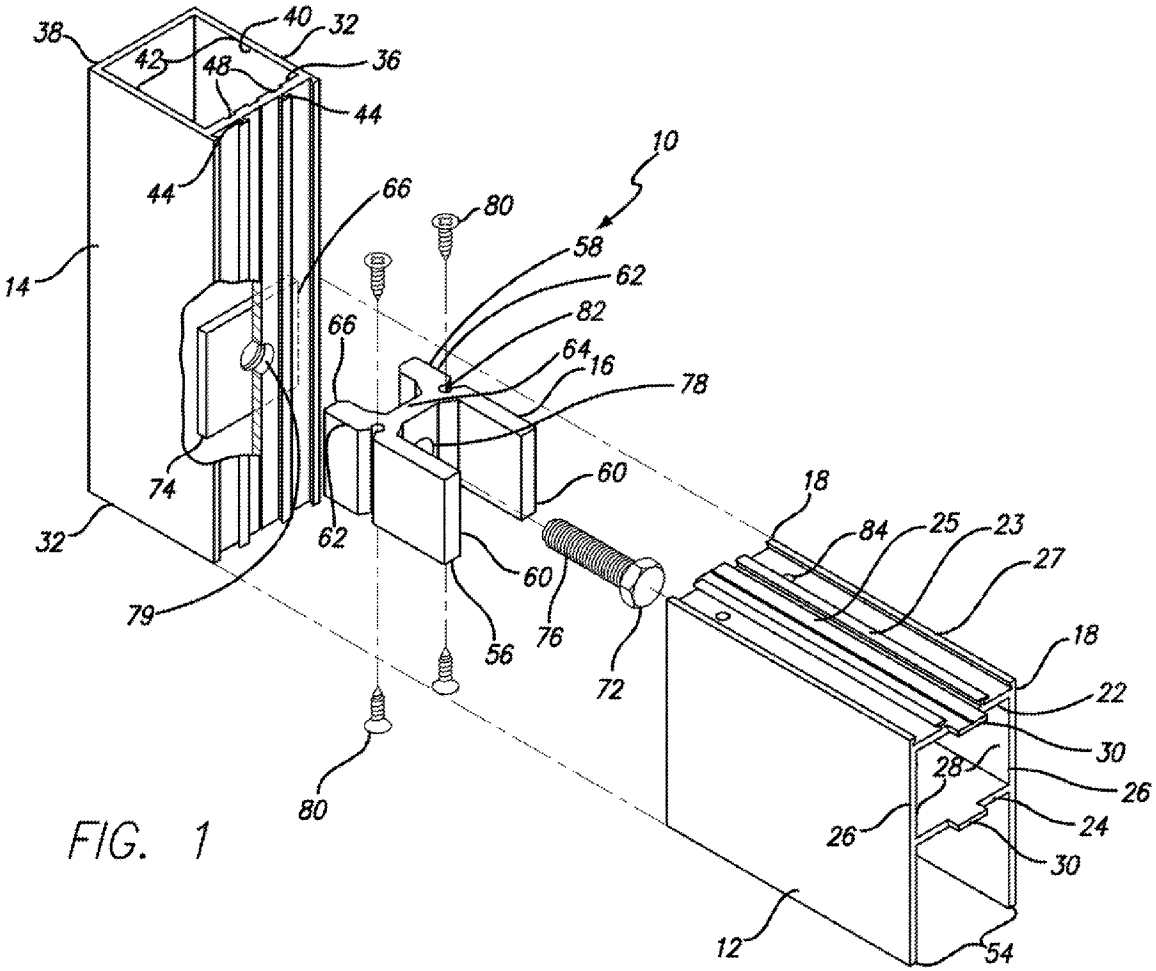
FIG. 1 is an exploded view of a corner assembly of the present invention showing a vertical framing member, horizontal framing member and sheer block, in accordance with the invention.
Figure 2:
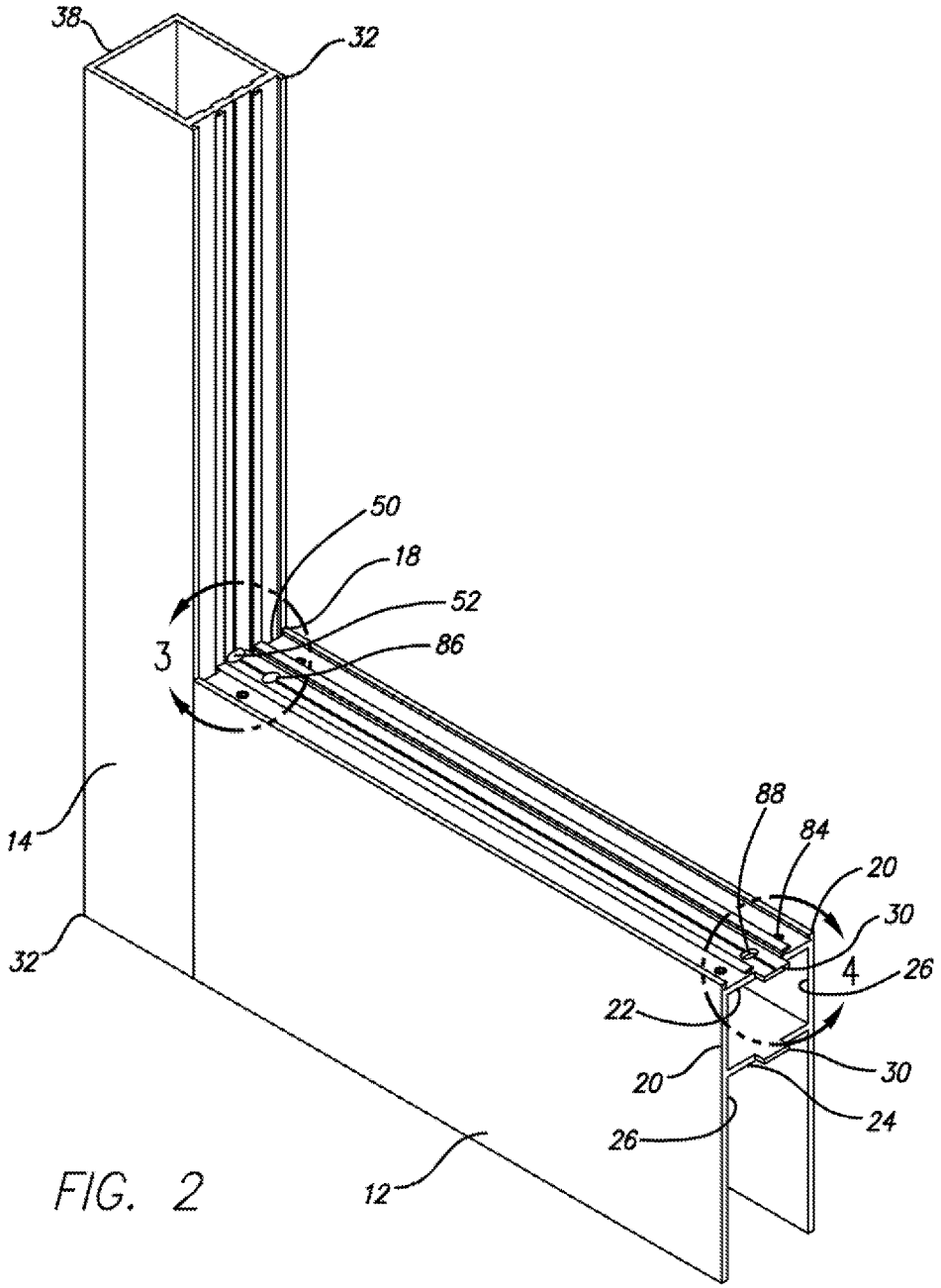
FIG. 2 is a perspective view of the corner assembly of FIG. 1, showing, although with different dimensions, a finished corner joint.

FIG. 1 shows an exploded view of a preferred embodiment of the door corner assembly 10 of the present invention, and FIG. 2 shows a finished assembly 10 in accordance with the present invention. FIGS. 1 and 2 show the preferred corner assembly 10 for only one of the four corners of the door. The assemblies of the three other corners of the door are identical in all material respects. The corner assembly of the present invention 10 is suitable for use with door, window and wall partition framing members of a variety of widths and depths. The present invention corner assembly is not limited to any particular framing member dimensions.

With reference to FIGS. 1-6, the new corner assembly 10 comprises a horizontal framing member 12, a vertical framing member 14 and a sheer block 16. The horizontal framing member 12 has ends 18. The horizontal framing member 12 is hollow with an upper wall 22, a lower wall 24 and side walls 26, which define a substantially square or rectangular cross section passageway 28 extending longitudinally between the ends 18. The upper wall 22 of the horizontal framing member 12 features tongues 30 which extend outwardly from the ends 18. Extending upwardly from the upper wall 22 of the horizontal framing member 12 are flanged walls 23 which define a center channel 25 therebetween. The center channel 25 extends longitudinally between the ends 18 of the horizontal framing member 12. The side walls 26 of the horizontal framing member 12 also extend upwardly of the upper wall 22 to form beveled extension walls 27. The flanged walls 23 and the beveled extension walls 27 define glazing retainer channels 29. The side walls 26 of the horizontal framing member 12 may extend downwardly below the bottom wall 24 to define an open channel section passageway 54 therebetween.

Figure 6:
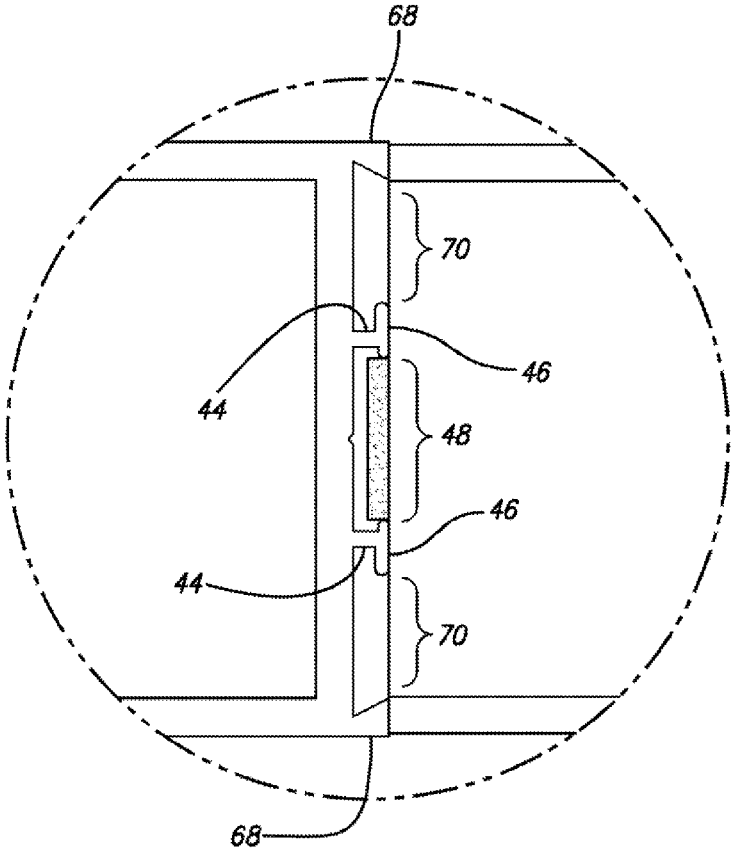
FIG. 6 is a detail view of the connection between the tongue of the horizontal framing member and the groove of the vertical framing member of FIG. 5.

The vertical framing member 14 has ends 32. The vertical framing member 14 is hollow with an inner wall 36, an outer wall 38 and side walls 40 which define a substantially square or rectangular cross section passageway 42 extending longitudinally between the ends 32. With particular reference to FIG. 6, the inner wall 36 of the vertical framing member 14 features outwardly extending walls 44 with lip flanges 46 which run longitudinally between the ends 32 of the vertical framing member 14 and which define a center groove 48. The side walls 40 of the vertical framing member 14 also extend outwardly of the inner wall 36 to form beveled extension walls 68. The outwardly extending walls 44 and the beveled extension walls 68 define outer grooves 70.

With reference to FIGS. 1-7, the tongue 30 of the upper wall 22 of the horizontal framing member 12 and groove 48 of the inner wall 36 of the vertical framing member 14 are configured such that the tongue 30 is slidably received within the groove 48 when an end 18 of the horizontal framing member 12 abuts the inner wall 36 of the vertical framing member 14 to form an intersection 50 between the horizontal framing member 12 and the vertical framing member 14. A weld 52 is made at the intersection 50 between the tongue 30 and the groove 48.

With particular reference to FIG. 1, the shear block 16 of the corner assembly 10 features an H-shaped cross section defined by a mutually opposed inner channel 56 and an outer channel 58. The inner channel 56 comprises side walls 60 connected to a center wall 64 with the side walls 60 defining the inner channel 56 therebetween. The outer channel comprises side walls 62 connected to the center wall 64 with the side walls 62 defining the outer channel 58 therebetween. In the exemplary embodiment of the shear block 16, the center wall 64 is common to both the inner and outer channels. The side walls 62 of the outer channel 58 of the h-shaped cross section have end abutment faces 66.

The H-shaped cross section of the shear block 16 is configured such that the walls 60 of the inner channel 56 are slidably received within the hollow square or rectangular cross section passageway 28 of the horizontal framing member 12 and the end abutment faces 66 of the outer channel 58 of the sheer block 16 are slidably received within the outer grooves 70 of the vertical framing member 14 and abut the inner wall 36 of the vertical framing member 14.

With reference to FIG. 1, in the exemplary embodiment, the sheer block is fastened to the vertical framing member 12 by means of a threaded fastener in the form of a bolt 72 and a nut 74. A threaded end 76 of the bolt 72 passes through a clearance hole 78 formed in the center wall 64 of the H-shaped cross section and a clearance hole 79 in the upper wall 36 of the vertical framing member 14, (the respective clearance holes 78 and 79 being axially aligned), to engage the nut 74. The nut 74 is disposed within the hollow square or rectangular cross section passageway 42 of the vertical framing member 14. In the exemplary embodiment, the nut 74 is a nut-plate configured to be slidably received within the cross section passageway 42 of the vertical framing member 14 and sized to have a width such that the nut 74 will be constrained from rotating by the side walls 40 of the cross section passageway 48 of the vertical framing member 14.

With continued reference to FIGS. 1-4, in the exemplary embodiment, the sheer block 16 is fastened to the horizontal framing member 12 by screws 80 which pass through clearance holes 84 in upper wall 22 and lower wall 24 of the horizontal framing member 12. The screws 80 engage with screw engagement portions 82 formed in the sheer block 16. The screw engagement portions 82 have holes or openings 81 for receipt of the screws 80. The sheer block 16 may be further secured to the horizontal framing rail 12 via a weld 86 between the sheer block 16 and the upper wall 22 of the horizontal framing rail 12. Weld penetration between the sheer block 16 and the upper wall 22 of the horizontal framing rail 12 may be enhanced by providing a slot 88 in the horizontal framing rail 12 at the point where the weld 86 is formed. In the exemplary embodiment, the slot 88 and the subsequently formed weld 86 are positioned such that the weld 86 occurs on the center wall 64 of the sheer block 16.

Figure 7:
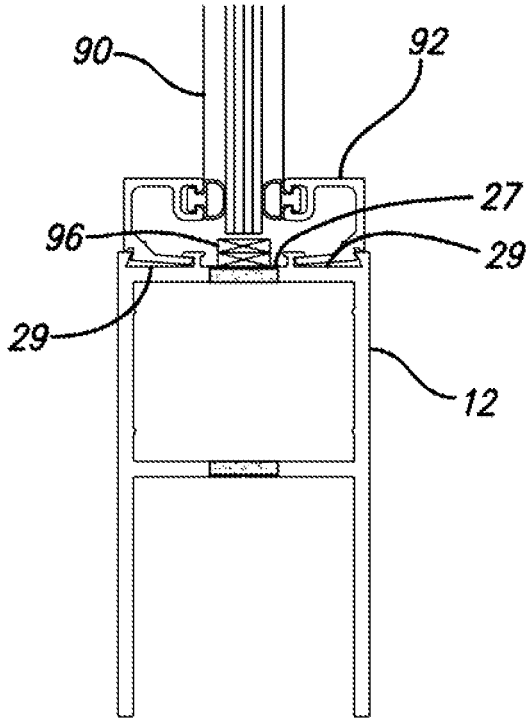
FIG. 7 is an end view of the horizontal framing member of FIG. 2, showing a door glass installed in the framing member.

Referring to FIG. 7, the horizontal framing member 12 is shown with a door glass 90 installed. The door glass 90 rests upon a setting block 96 which is slidably received within the center channel 25. Fitted within the glazing retainer channels 29 on each side of the door glass 90 are snap-in glazing strips 92 which serve to seal the door glass 90 from the elements.

The horizontal framing rail 12, vertical framing rail 14, and sheer block 16 are preferably aluminum extrusions as aluminum is of relatively light weight with high strength and several alloys that are both weldable and readily produced in extruded form are commercially available. Metallic materials other than aluminum may be used to form the horizontal and vertical framing rails and shear block. Likewise several types of plastic materials are readily extrudable and have sufficient strength to serve in the application.

With reference to FIGS. 1-7, the corner assembly 10 of the present invention is assembled as follows. The shear block 16 is attached to the vertical framing member 14 by means of the clamp bolt 72 which passes through the clearance hole 78 in the center wall 64 of the shear block 16 and through a clearance hole 79 in the upper wall 36 of the vertical framing member 14. The clamp bolt 72 engages the nut plate 74 which is vertically positioned within the vertical framing member 14. The clamp bolt 20 is tightened sufficiently to secure the shear block 16 against the inner wall 36 of the vertical framing member 14 by means of clamping force.

Thereafter, the horizontal framing member 12 is secured to the vertical framing member 14 such that the shear block 16 (secured to the vertical framing member via the clamp bolt 72 and nut 74) slides within the square or rectangular passageway 28 of the horizontal framing member 12 and the tongue 30 of the horizontal framing member 12 engages, i.e. is slideably received within the groove 48 of the vertical framing member 14. Thereafter, the horizontal framing member 12 is secured to the shear block 16 by means of fasteners such as screws 80, which may be self-threading sheet metal screws, which pass through holes 84 in the upper wall 22 and lower wall 24 of the horizontal framing member 12 to engage the screw engagement portions 82 of the shear block 16. The screws 80 are sufficiently tightened to securely engage the horizontal framing member 12 to the vertical framing member 14.

Figure 8:
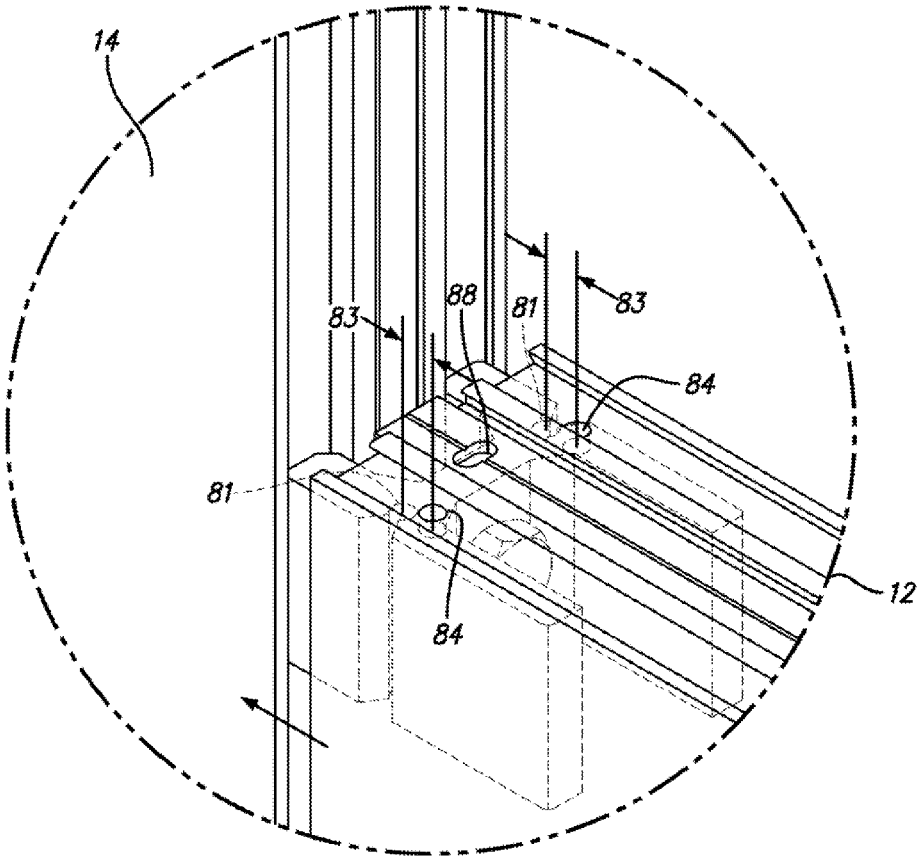
FIG. 8 is a detail view of the corner assembly of FIG. 1, shown prior to final finishing operations.

With reference to FIG. 8, when the horizontal framing member 12 is positioned flush against the vertical framing member 14, the clearance holes 84 in the upper and lower walls 22 and 24 of the horizontal framing member 12 are intentionally offset, or misaligned from the holes or openings 81 in screw engagement portions 82 of the sheer block 16. The intentional misalignment or offset 83 is shown in FIG. 8. More specifically, the holes 84 of the horizontal framing member 12 are offset outwardly from the vertical framing member 14, as shown in FIG. 8, so that when the holes 84 are forced into alignment with the openings 81 of the screw engagement portions 82 of the sheer block 16, and subsequently secured by the screws 80, compression is induced at the interface between the members 12 and 14.

The compression created at the interface between the horizontal and vertical framing members 12 and 14 serves two principle purposes, i.e. the compression creates a more rigid corner joint and it serves to close any gaps that may exist at the interface between the two rails and thus improves the aesthetics of the joint. Experimentation has shown that an offset 83 between the holes 84 of horizontal framing member 12 and the openings 81 in the sheer block 16 within the range of about 0.030 to 0.040 inch to be sufficient to stiffen the corner joint and to close any gaps between the horizontal and vertical framing member 12 and 14.

Figure 3:
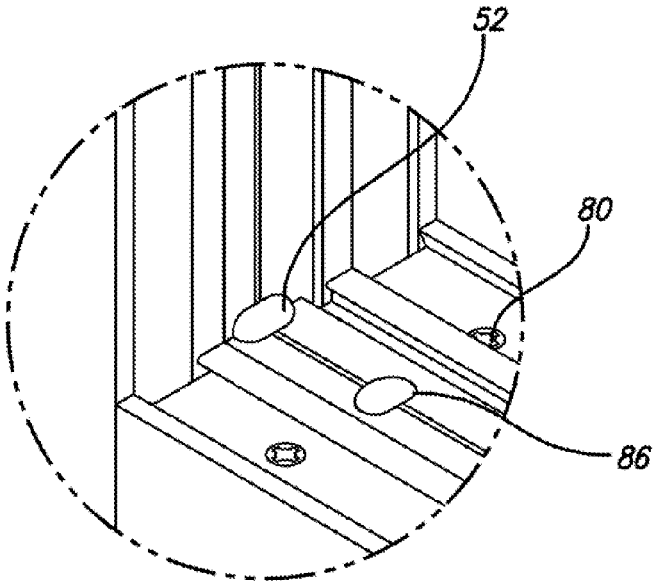
FIG. 3 is a detail of the corner assembly of FIG. 2.
Figure 4:
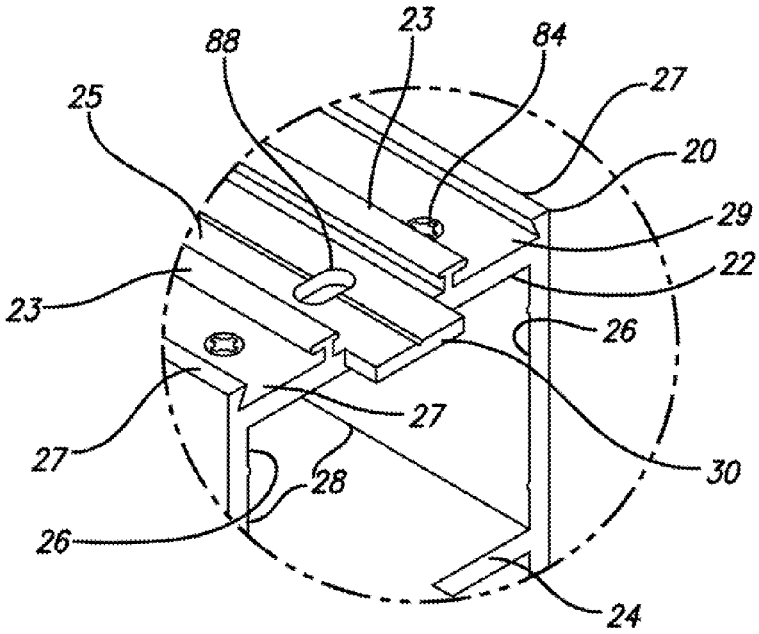
FIG. 4 is an end detail of an end of the horizontal framing member of FIG. 1.
Figure 5:
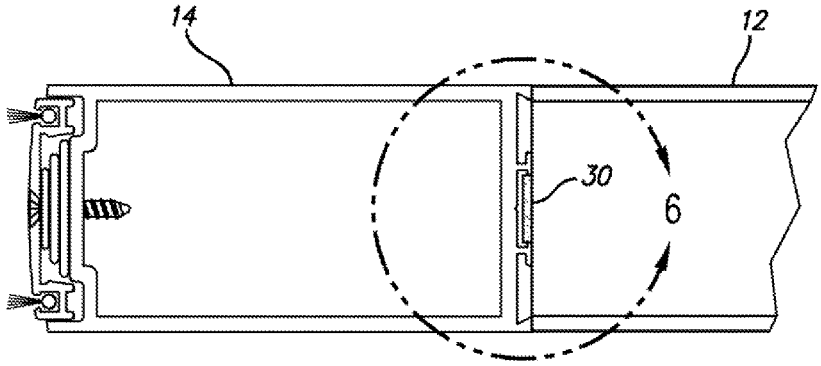
FIG. 5 is a partial top view of the corner assembly of FIG. 2 showing the a tongue of the horizontal framing member engaged with a mating groove of the vertical framing member.

With reference to FIGS. 2 through 4, as a final assembly procedure for the corner assembly 10, the horizontal framing member 12 and the vertical framing member 14 are further secured by means of a weld 52 at the intersection of the horizontal 12 and vertical 14 framing members 50. In particular, the weld 52 is made at the interface between the tongue 30 of the horizontal framing member 12 and the groove 48 of the vertical framing member 14. Welding at this intersection provides for greater weld area and better weld penetration between the horizontal 12 and vertical 14 framing members. The horizontal framing member 12 is additionally secured to the shear block 16 by means of a weld 86 which is formed at the slot 88 (see FIG. 4), which is spaced to align with the center wall 64 of the shear block 16. The slot 88 in the horizontal framing member 12 ensures adequate penetration and fusion of the weld 86 connecting the horizontal framing member 12 to the shear block 16.

The corner joint 10 of the present invention lends itself well to production using computer numerical controlled ("CNC") machining equipment. The use of CNC equipment to finish the extrusions from which the horizontal 12 and vertical 14 framing members, as well as the sheer block 16 are made reduces the errors inherent in non-CNC machining operations and thereby improves the overall quality of the product, as well as the processing efficiency, production scheduling, and cost accountability of the manufacturing process.

The use of CNC machining equipment is of particular value in forming the tongue 30 of the horizontal framing member 12. The tongue cannot readily be produced with sufficient precision using hand controlled machining equipment. CNC machining equipment is also of particular value in forming the screw holes 84 of the horizontal framing member 12. CNC machining allows the holes 84 to placed very accurately relative to an end of the horizontal framing member. Prototype development has shown that similar accuracy cannot readily be obtained with non-CNC equipment.

The corner assembly of the present invention 10 will typically be used to form door and window frames or wall partitions where a glass pane 90 is desired to be used. In the exemplary embodiment, reference is made to a glass pane. However, the corner assembly 10 of the present invention may be used to frame flat panels comprised of a variety of materials including wood, metallic materials and plastic materials. The panel to be secured is held within the frame constructed using the corner assembly 10 of the present invention using window glazing techniques of which many are known in the art.

The improved corner joint 10 of the present invention has been described as using a tongue 30 formed on the horizontal framing member 12 to interface with a groove 48 in the vertical framing member 14. In some glass door, window or wall partition installations however, it may prove impracticable to include the tongue 30 of the present invention in the corner joint assembly. In such installations, glass doors, windows and wall partitions my nevertheless be framed using the same horizontal and vertical framing members 12 and 14 and sheer block 16 and method of assembly of the corner joint assembly 10 of the present invention, with the only modification being the lack of a tongue 30 formed on horizontal framing member 12. Corner joints 10 constructed without the tongue 30, while not as strong as corner joints that include the tongue 30, are nevertheless sufficiently strong for some types of installations.

As described, a new corner assembly for use in framing glass doors, windows or wall partitions has been presented. Frames constructed using the new corner assembly provide better resistance to rail twist and frame racking. The new corner assembly provides these improvements through the provision of the tongues 30 on each horizontal framing member 12 which mate with the grooves 48 on adjacent vertical framing members. (The tongue and groove arrangement may be reversed, i.e. the tongues may be formed on the vertical framing member to mate with grooves on the horizontal framing member.) The tongues achieve this improvement by improving the alignment between the horizontal 12 and vertical 14 framing members and the shear block 16, and by improving the strength of the weld at the junction of the framing members.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. A corner assembly for a door, window or wall partition, the corner assembly comprising:

a horizontal framing member having an end, the framing member being hollow with an upper wall, lower wall and side walls defining a substantially rectangular cross section passageway extending longitudinally from the end;

the upper wall of the horizontal framing member having a tongue extending outwardly from the end;

a vertical framing member having art end, the framing member being hollow with an inner wall, outer wall and side walls defining a substantially rectangular cross section passageway extending longitudinally from the end;

the inner wall of the vertical framing member having a groove extending longitudinally from the end;

wherein the tongue of the upper wall of the horizontal framing member and groove of the upper wall of the vertical framing member are configured such that the tongue is slidably received within the groove when the end of the horizontal framing member abuts the inner wall of the vertical framing member to form an intersection between the tongue and the groove;

a weld at the intersection between the tongue and the groove;

a shear block, the shear block having an H-shaped cross section defined by mutually opposed inner and outer channels, the channels each comprising first and second side walls and a center wall common to each channel connecting the respective first and second side walls;

the first and second side walls of the outer channel of the H-shaped cross section having end abutment faces;

wherein the H-shaped cross section of the shear block is configured such that the walls of the inner channel are slidably received within the hollow rectangular cross section passageway of the horizontal framing member, and the end abutment faces of the outer channel abut the upper wall of the vertical framing member;

fastening means for securing the sheer block to the vertical framing member; and fastening means for securing the sheer block to the horizontal framing member.

2. The corner assembly for a door, window or wall partition of claim 1, wherein the groove is defined by spaced part walls extending outwardly from the inner wall of the vertical framing member and running longitudinally along the vertical framing member from the end thereof.

3. The corner assembly for a door, window or wall partition of claim 1, wherein the fastening means for securing the sheer block to the vertical framing member comprises a threaded fastener in the form of a bolt and a nut, wherein a threaded end of the bolt passes through a hole formed in the center wall of the h-shaped cross section and a hole in the inner wall of the vertical framing member, the respective holes being aligned, to engage the nut, the nut being disposed within the hollow rectangular cross section of the vertical framing member.

4. The corner assembly for a door, window or wall partition of claim 3, wherein the nut is a nut-plate configured to be slidably received within the cross section passageway of the vertical framing member and sized to have a width such that the nut will be constrained from rotating by the side walls of the cross section passageway of the vertical framing member.

5. The corner assembly for a door, window or wall partition of claim 1, wherein the fastening means for securing the sheer block to the horizontal framing member comprises at least one hole formed in at least one horizontal wall of the horizontal framing member, the at least one hole in the horizontal framing member being aligned with at least one hole formed in at least one screw attachment portion formed in the sheer block, wherein at least one screw interconnects the sheer block and the horizontal framing member by passing through the at least one hole in the at least one horizontal wall of the horizontal framing member to engage the at least one hole in the at least one screw attachment portion of the sheer block.

6. The corner assembly for a door, window or wall partition of claim 5, wherein the at least one hole in the upper wall of the horizontal framing member and the at least one hole in the at least one screw engagement portion of the sheer block are offset prior to insertion of the at least one screw, wherein insertion of the at least one screw aligns the at least one hole in the horizontal framing member with the at least one hole in the sheer block, whereby compression is created between the horizontal and vertical framing members.

7. The corner assembly for a door, window or wall partition of claim 6, wherein the fastening means for securing the sheer block to the horizontal framing member further comprises at least one weld interconnecting the sheer block and the horizontal framing member.

8. The corner assembly for a door, window or wall partition of claim 7, wherein the at least one weld interconnects the upper wall of the horizontal framing member with the center wall of the shear block.

9. The corner assembly for a door, window or wall partition of claim 1, wherein the side walls of the horizontal framing member extend below the lower wail to define an open channel section passageway therebetween.

10. A corner assembly for a door, window or wall partition, the corner assembly comprising:

a horizontal framing member having an end, the framing member being hollow with an upper wall, lower wall and side walls defining a passageway extending longitudinally from the end;

the upper wall of the horizontial framing member having a tongue extending outwardly from the end;

a vertical framing member having an end, the framing member being hollow with an inner wall, outer wall and side walls defining a passageway extending longitudinally from the end;

the inner wall of the vertical framing member having a groove spaced longitudinally from the end;

wherein the tongue of the upper wall of the horizontal framing member and groove of the inner wall of the vertical framing member are configured such that the tongue is slidably received within the groove when the end of the horizontal framing member abuts the inner wall of the vertical framing member to form an intersection between the members; and a weld at the intersection between the members;

a shear block interconnecting the vertical and horizontal framing members;

fastening means for securing the sheer block to the vertical framing member;

fastening means for securing the sheer block to the horizontal framing member;

wherein the shear block comprises:

an H-shaped cross section defined by mutually opposed inner and outer channels, the channels each comprising first and second side walls and a center wall common to each channel connecting the respective first and second side walls;

the first and second side walls of the outer channel of the H-shaped cross section having end abutment faces; and wherein the H-shaped cross section of the shear block is configured such that the walls of the inner channel are slidably received within the hollow cross section passageway of the horizontal framing member and the end abutment faces of the outer channel abut the upper wall of the vertical framing member.

11. The corner assembly for a door, window or wall partition of claim 10, wherein the fastening means for securing the sheer block to the horizontal framing member comprises at least one screw interconnecting the upper wall of the horizontal framing member with the center wall of the sheer block.

12. The corner assembly for a door, window or wall partition of claim 11, wherein the fastening means for securing the sheer block to the horizontal framing member further comprises at least one weld interconnecting the upper wall of the horizontal framing member with the center wall of the sheer block.

13. The corner assembly for a door, window or wall partition of claim 10, wherein the fastening means for securing the sheer block to the vertical framing member comprises a threaded fastener in the form of a bolt and a nut, wherein a threaded end of the bolt passes through a hole formed in the center wall of the H-shaped cross section and a hole in the inner wall of the vertical framing member, the respective holes being aligned, to engage the nut, the nut being disposed within the hollow cross section of the vertical framing member.

14. The corner assembly for a door, window or wall partition of claim 13, wherein the nut is a nut-plate configured to be slidably received within the passageway of the vertical framing member and sized to have a width such that the nut will be constrained from rotating by the side walls of the passageway of the vertical framing member.

15. A corner assembly for a door, window or wall partition, the corner assembly comprising:

a horizontal framing member having an end, the framing member being hollow with an upper wall, lower wall and side walls defining a substantially rectangular cross section passageway extending longitudinally from the end;

a vertical framing member having an end, the framing member being hollow with an inner wall, outer wall and side walls defining a substantially rectangular cross section passageway extending longitudinally from the end;

wherein, the end of the horizontal framing ember abuts the upper wall of the vertical framing member;

a weld at the intersection between the end of the horizontal framing member and the upper wall of the vertical framing member;

a shear block, the shear block having an H-shaped cross section defined by mutually opposed inner and outer channels, the channels each comprising first and second side walls and a center wall;

the first and second side wails of the outer channel of the 14-shaped cross section having end abutment faces;

wherein the H-shaped cross section of the shear block is configured such that the walls of the inner channel are slidably received within the hollow rectangular cross section passageway of the horizontal framing member, and the end abutment faces of the outer channel abut the upper wall of the vertical framing member;

fastening means for securing the sheer block to the vertical framing member; and fastening means for securing the sheer block to the horizontal framing member.

16. The corner assembly for a door, window or wall partition of claim 15, wherein the fastening means for securing the sheer block to the vertical framing member comprises a threaded fastener in the form of a bolt and a nut, wherein a threaded end of the bolt passes through a hole formed in the center wall of the h-shaped cross section and a hole in the inner wall of the vertical framing member, the respective holes being aligned, to engage the nut, the nut being disposed within the hollow rectangular cross section of the vertical framing member.

17. The corner assembly for a door, window or wall partition of claim 16, wherein the nut is a nut-plate configured to be slidably received within the cross section passageway of the vertical framing member and sized to have a width such that the nut will be constrained from rotating by the side walls of the cross section passageway of the vertical framing member.

18. The corner assembly for a door, window or wall partition of claim 15, wherein the fastening means for securing the sheer block to the horizontal framing member comprises at least one hole formed in at least one horizontal wall of the horizontal framing member, the at least one hole in the horizontal framing member being aligned with at least one hole formed in at least one screw attachment portion formed in the sheer block, wherein at least one screw interconnects the sheer block and the horizontal framing member by passing through the at least one hole in the at least one horizontal wall of the horizontal framing member to engage the at least one hole in the at least one screw attachment portion of the sheer block,

19. The corner assembly for a door, window or wall partition of claim 18, wherein the at least one hole in the upper wall of the horizontal framing member and the at least one hole in the at least one screw engagement portion of the sheer block are offset prior to insertion of the at least one screw, wherein insertion of the at least one screw aligns the at least one hole in the horizontal framing member with the at least one hole in the sheer block, whereby compression is created between the horizontal and vertical framing members.

20. The corner assembly for a door, window or wall partition of claim 18, wherein the fastening means for securing the sheer block to the horizontal framing member further comprises at least one weld interconnecting the sheer block and the horizontal framing member.

21. The corner assembly for a door, window or wall partition of claim 20, wherein the at least one weld interconnects the upper wall of the horizontal framing member with the center wall of the shear block.

22. The corner assembly for a door, window or wall partition of claim 15, wherein the side walls of the horizontal framing member extend below the lower wall to define an open channel section passageway therebetween.

23. A corner assembly for a door, window or partition, the corner assembly comprising:

a horizontal framing member having an end, the framing member being hollow with an upper wall, lower wall and side walls defining a passageway extending longitudinally from the end;

the upper wall of the horizontal framing member having a tongue extending outwardly from the end;

a vertical framing member having an end, the framing member being hollow with an inner wall, outer wall and side walls defining a passageway extending longitudinally from the end;

the inner wall of the vertical framing member having a groove spaced longitudinally from the end;

wherein the tongue of the upper wall of the horizontal framing member and groove of the inner wall of the vertical framing member are configured such that the tongue is slidably received within the groove when the end of the horizontal framing member abuts the inner wall of the vertical framing member to form an intersection between the horizontal and vertical framing members;

a weld at the intersection between the horizontal and vertical framing members;

a shear block interconnecting the vertical and horizontal framing members;

fastening means for securing the sheer block to the vertical framing member;

fastening means for securing the sheer block to the horizontal framing member; and wherein the fastening means for securing the sheer block to the horizontal framing member comprises at least one screw interconnecting the sheer block and the horizontal framing member.

24. The corner assembly for a door, window or wall partition of claim 23, wherein the groove is defined by spaced part walls extending outwardly from the inner wall of the vertical framing member and running longitudinally along the vertical framing member from the end thereof.

25. The corner assembly for a door, window or wall partition of claim 23, wherein the fastening means for securing the sheer block to the horizontal framing member further comprises at least one weld interconnecting the sheer block and the horizontal framing member.

26. The corner assembly for a door, window or Wall partition of claim 23, wherein the shear block comprises:

an H-shaped cross section defined by mutually opposed inner and outer channels, the channels each comprising first and second side walls and a center wall common to each channel connecting the respective first and second side walls;

the first and second side walls of the outer channel of the H-shaped cross section having end abutment faces; and wherein the H-shaped cross section of the shear block is configured such that the walls of the inner channel are slidably received within the hollow cross section passageway of the horizontal framing member and the end abutment faces of the outer channel abut the upper wall of the vertical framing member.

27. The corner assembly for a door, window or wall partition of claim 26, wherein the fastening means for securing the sheer block to the horizontal framing member comprises at least one screw interconnecting the upper wall of the horizontal framing member with the center wall of the sheer block.

28. The corner assembly for a door, window or wall partition of claim 27, wherein the fastening means for securing the sheer block to the horizontal framing member further comprises at least one weld interconnecting the upper wall of the horizontal framing member with the center wall of the sheer block.

29. The corner assembly for a door, window or wall partition of claim 26, wherein the fastening means for securing the sheer block to the vertical framing member comprises a threaded fastener in the form of a bolt and a nut, wherein a threaded end of the bolt passes through a hole formed in the center wall of the H-shaped cross section and a hole in the inner wall of the vertical framing member, the respective holes being aligned, to engage the nut, the nut being disposed within the hollow cross section of the vertical framing member.

30. The corner assembly for a door, window or wall partition of claim 29, wherein the nut is a nut-plate configured to be slidably received within the passageway of the vertical framing member and sized to have a width such that the nut will be constrained from rotating by the side walls of the passageway of the vertical framing member.

31. The corner assembly for a door, window or wall partition of claim 23, wherein the side walls of the horizontal framing member extend below the bottom wall to define an open channel section there between.

* * * * *